United States Patent [19]

Piedmont et al.

[11] 4,228,418

[45] Oct. 14, 1980

[54] MODULAR TRIM RESISTIVE NETWORK

[75] Inventors: James R. Piedmont, Alexandria; Michael Hacskaylo, Falls Church, both of Va.

[73] Assignee: The United States of America as represented by the Secretary of the Army, Washington, D.C.

[21] Appl. No.: 24,808

[22] Filed: Mar. 28, 1979

[51] Int. Cl.[3] ..... H01C 10/00

[52] U.S. Cl. ..... 338/195; 338/320

[58] Field of Search ..... 338/195, 308–309, 338/320, 333, 334; 29/620

[56] References Cited

U.S. PATENT DOCUMENTS

| | | | |
|---|---|---|---|
| 2,261,667 | 11/1941 | Stroszeck | 338/195 |
| 2,748,234 | 5/1956 | Clarke et al. | 338/195 |
| 4,019,168 | 4/1977 | Collins | 338/195 X |

OTHER PUBLICATIONS

A. Bross, et al., *IBM Technical Disclosure Bulletin*, "Modular Resistor Array", vol. 13, No. 5, Oct. 1970.

*Primary Examiner*—C. L. Albritton

*Attorney, Agent, or Firm*—Nathan Edelberg; Robert P. Gibson; Milton W. Lee

[57] ABSTRACT

A modular trim resistive network providing adjustable in-circuit resistance. The network essentially consists of multiple parallel connected single or double branched series divided resistive elements of which the elements may be separate and distinct or diffused onto or into the surface of an integrated circuit. In either instance the elements are interconnected by conductive leads in such a manner that the selective severing of various leads results in the desired matching network resistance.

1 Claim, 3 Drawing Figures

MODULAR TRIM RESISTIVE NETWORK

The invention described herein may be manufactured, used, and licensed by the U.S. Government for governmental purposes without the payment of any royalties thereon.

BACKGROUND OF THE INVENTION

This invention relates generally to variable resistance means and more specifically to a trimmable resistive network utilized primarily in conjunction with an integrated circuit.

In the fabrication and assembly of electronic components, many instances arise where the specific value of a required resistive element is not known until the fabrication and/or actual assembly of all the components are completed and various tests are conducted. An accurate determination of the value of resistance required quite often entails the physical substitution of resistive elements until the desired results are achieved.

In the integrated circuit (IC) technology, numerous techniques have been devised for providing resistors within the IC chip as fabricated, as well as for physically mounting chip resistors on the surface of the IC chip. These techniques have been relatively successful but in each instance the procedures for obtaining the proper value of resistance required for the particular application is most tedious and time consuming. In the case of fabricating resistors into an IC device during the fabrication process, it becomes near impossible to predict the proper value of resistance that will be required, as each separate element within the IC will be non-uniform from chip to chip, such that the value of resistance required for matching will vary greatly with each new fabrication. In regard to physically mounting chip resistors on the surface of the IC, for matching purposes, it becomes necessary to provide means for varying the resistance to achieve the proper matching. The present techniques employed for changing the value of the resistor for matching purposes consists of physically trimming the resistors or replacing the chip resistor with one of another size, or at the least, mounting additional series or parallel chip resistors to obtain the maching value desired.

SUMMARY OF THE INVENTION

The instant invention provides a technique for obtaining a wide range of resistance without the attendant disadvantages experienced by the prior art and essentially consists of a multiple array of resistor elements, which may be separate and distinct interconnected elements, or elements diffused into or deposited onto the surface of an IC. In either instance, the resistive elements are interconnected along respective ends of conductive leads and may take the form of a multiple parallel connected single or double branched series divided resistive element array. A parallel resistor network presents a minimum network resistance but can be adjusted to exhibit a higher resistance by severing selective conductive leads in a manner to effectively convert as many parallel resistor elements into series and series-parallel resistor elements as is necessary to achieve the desired network resistance value.

DESCRIPTION OF THE PREFERRED EMBODIMENTS

Figure 1:
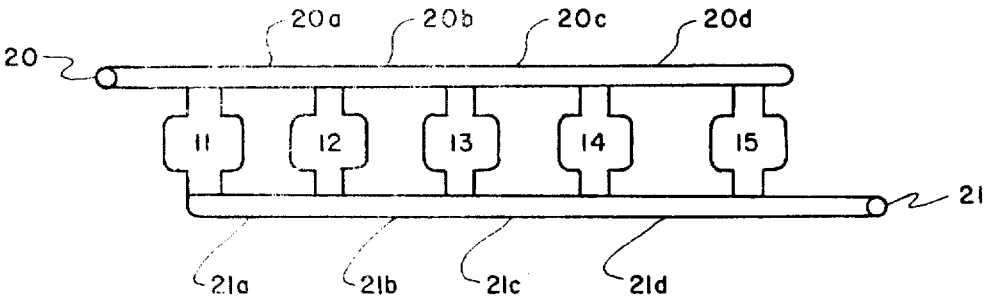
FIG. 1 shows a single branch trimmable resistive network as one embodiment of this invention.

A description of one preferred embodiment of this invention may best be understood by reference to FIG. 1, wherein any number of parallel resistive elements, depicted by segments 11, 12, 13, 14, 15, may be interconnected at terminals 20 and 21 and either fabricated, assembled or integrated into an electronic circuit. A number of network trim combinations would be available to provide a wide range of resistance values.

One embodiment of this invention is shown in FIG. 1, wherein a number of essentially equal resistive elements depicted as 11, 12, 13, 14, and 15 are shown connected in parallel between conductive strips 20 and 21. The resistive ladder network may be fabricated by various techniques well known in the art, such as by masking a substrate layer and depositing the resistive and conductive materials directly onto the substrate. The particular technique used in the deposition process may be selected from well known methods in the diffusion technology and is normally selected from the following criteria. If the resistive material is Cermet (CrSiO) then deposition would be by flash evaporation; semiconductors (such as $SnO_2$, carbon) by hydrolysis and pyrolysis, respectively; metal alloy systems (such as nichrome) by evaporation or bias sputtering; and single metal (Ta nitride, Ta) by sputtering while Cr would be deposited by sublimation. Resistive and conductive materials used in the fabrication process are also well known in the art and include a number of resistive materials in addition to the above, such as Re and $Al_2O_3$ as well as conductive materials of CrAl, CrAu, CrCu, CrCuAu, Au, Inconel, etc.

The resistive elements may also be any of various types of resistive devices, such as discrete resistors, thick and thin film resistors and chip resistors. Resistor chips are physically affixed to a substrate and interconnected by thermocompression ball-bonding, for instance, by ohmic contact leads, such as gold, which may be pattern metallized onto the substrate.

The resistive ladder network of FIG. 1 exhibits a minimum resistance when all the resistive elements are connected in parallel. The effective resistance of the resistive network may be increased merely by severing various segments of the conductive strips 20 and 21, in a zig-zag fashion, to place as many resistive elements as desired in series with the remaining parallel resistive elements. For example, upon severing segment **20*a*, only resistive element 11 would be in the circuit between terminals 20 and 21, but upon severing segments 20*a* and 21*b*, resistive elements 11 and 12 would be effectively placed in series with the parallel combination of resistive elements 13, 14, and 15**.

Severing the various interconnecting segments of the conductive strips 20 and 21 may be accomplished by several techniques, encompassing any of several well known technologies, such as laser severing, sandblast scribing, electron beam severing, etching, etc. The resistive network may be trimmed to precise values simply by selectively severing the interconnecting segments in a zig-zag pattern while some parameter indicative of the resistance of the network in question is being monitored.

One specific application for the above trimmable resistive ladder network lies in the area of normalization of the optical power output of multielement arrays of light emitting diodes (LED). During the fabrication process of LED assemblies, it is desirable to provide passive circuitry to normalize the optical power output from each diode elements to some desired level, given a nominal input voltage. The output power levels from all the array elements must track together within prescribed tolerances as the input voltage changes, and must continue to track even during unfavorable environmental conditions.

Figure 2:
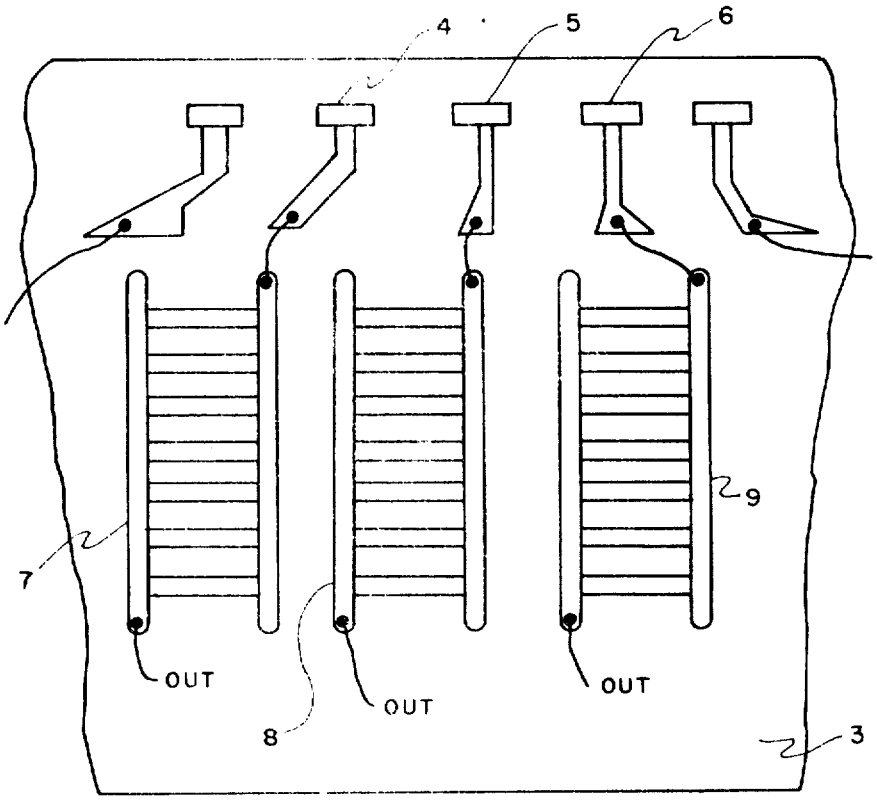
FIG. 2 shows the trimmable resistive network of FIG. 1 incorporated into an integrated circuit.

Normalization of the LED array can be achieved as depicted in FIG. 2, wherein several LEDs 4, 5, and 6 are shown with trimmable resistive ladder networks 7, 8, and 9 interconnecting the LEDs with a control circuit. The optical power output is normalized by energizing the circuit and trimming the resistive networks by any of the above noted techniques until the desired output is achieved. As explained in conjunction with FIG. 1, resistive trimming is accomplished by severing the various lead segments interconnecting the resistive elements until the desired parameter is obtained. Trimming in this manner can be accomplished in an extremely short period of time compared to the techniques heretofore utilized.

The ladder networks 7, 8 and 9, shown generally in FIG. 2, and specifically in FIG. 1, may be fabricated on a substrate, such as substrate 3 of FIG. 2, by any of several deposition processes as above noted.

Conductive strips 20 and 21 may be deposited on a substrate with a second deposition of some resistive material deposited through a mask to bridge the conductive strips. The reverse deposition processes would also be applicable in this instance where the resistive material is deposited prior to the application of conductive terminal strips. The conductive strips may be any highly conductive material, but gold has been found to be one of the best. The resistive material deposited through the mask may also be any of several well known materials selected from the above noted group.

Figure 3:
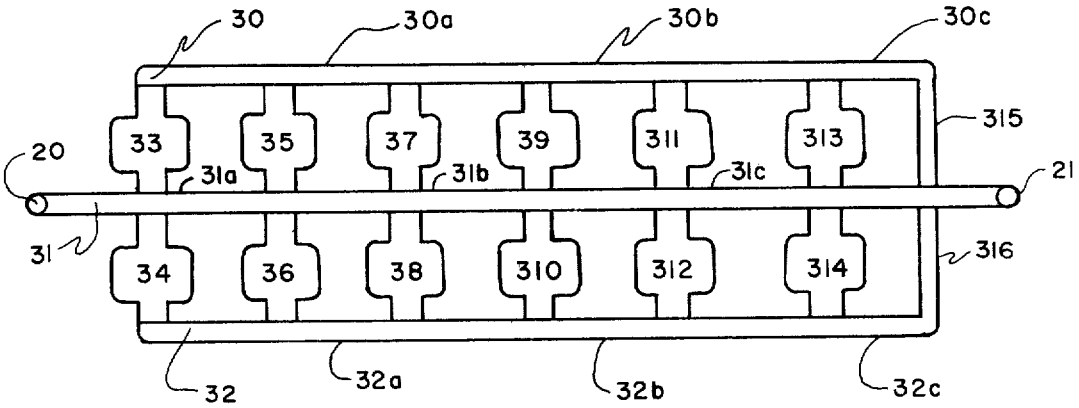
FIG. 3 shows a second embodiment of the invention in the form of a double branch resistive network.

Another preferred embodiment of this invention is shown in FIG. 3, wherein any number of parallel two-branched series divided elements, depicted as segments 33, 34, . . . 313, 314 and common conductors 315 and 316 may be interconnected by conductive strips 30, 31, and 32 and either fabricated, assembled or integrated into an electronic circuit in lieu of the above noted first preferred embodiment. The number and value size of the individual resistive elements may be selectively chosen to essentially provide any desired range of resistance values for the network.

Referring now to FIG. 3, a number of two-branched series resistors of essentially equal resistive elements depicted as 33, 34 . . . 313, 314 are shown connected in parallel between conducting strips 30, 31 and 32. The resistive and conductive portions of the network may be fabricated as noted in the previous example and the materials so noted may also be used for fabricating the two-branched network.

The resistive network of FIG. 3 exhibits a minimum resistance when all the two-branched series divided resistive elements are connected in parallel. The effective resistance of the network may be increased merely by severing various segments of the conductive strips 30, 31 and 32 in a specific manner, to plan as many two-branched series resistive elements as desired in parallel and series-parallel fashion with corresponding increasing resistance valves. For example, upon severing segment 31*a*, the resistive elements 33 and 34 would be parallel in the circuit between terminals 20 and 21 and the value of the circuit resistance $R_1$ due to the first cut would be $R_{33} \times R_{34}/(R_{33}+R_{34})$. Continuing the process, and upon severing segments 30*a* and 32*a*, the resistive elements 33 and 35 would be series-parallel with resistive elements 34 and 36, and the value of the circuit resistance $R_2$ due to the second severing process would be $(R_{33}+R_{35})(R_{34}+R_{36})/(R_{33}+R_{35}+R_{34}+R_{36})$. Note that the resistive elements for $R_1$ becomes incorporated into $R_2$. The second cutting incorporates the cluster of the first four resistive elements. Continuing the process, and upon severing segment 31*b*, the resistive elements 37 and 38 would be parallel with each other and the increased value of the circuit resistance $R_3$ due to the third severing would be $R_{37}R_{38}/R_{37}+R_{38}$, and that the resistive elements of $R_1$ and $R_2$ are not incorporated in $R_3$. The circuit resistance is $R_2+R_3$. In a comparable fashion upon severing segments 30*b* and 32*b*, the increased value of the circuit resistance $R_4$ due to the fourth severing would be $(R_{37}+R_{38})(R_{39}+R_{310})(R_{37}+R_{38}+R_{39}+R_{310})$. Note that the second cluster and four resistive elements of $R_3$ become incorporated in $R_4$. The circuit resistance is $R_2+R_4$. The network trimming is continued in the described manner until the desired circuit resistance is obtained. The complexity of the determination of the circuit resistance is reduced by fabricating or producing resistive elements which are the same resistive value. It can be readily shown that in the case where the values of the resistive elements are identified, the resistance of the resistive network increases by one-half the resistance value of the resistive elements for each time the severing process is applied as described above.

It should be understood that the foregoing disclosure relates only to the two described embodiments of the invention and that numerous modifications or alterations may be made therein without departing from the spirit and the scope of the invention as set forth in the appended claims.

We claim:

1. A trimmable resistive network consisting of a plurality of two-branched series resistors of essentially equal resistive elements connected in parallel, wherein each parallel branch consists of two resistive elements having first and second ends with the second ends connected in common;

first and second conductive means including severable segmented conductive portions progressively interconnecting corresponding respective resistive element ends with the first conductive means interconnecting all the first ends of the resistive elements and the second conductive means interconnecting all the second ends of the resistive elements;

an input terminal connected to the second conductive means and an output terminal connected to a common junction of the first and second conductive means whereby selective severing of the segmented conductive sections selectively provides for separate input and output paths for a simple trimmable resistive network of parallel resistive elements or a parallel two branched series resistive network and whereby further selective severing of various segments of the conductive means interconnecting the ends of the various resistive elements provides for a precisely controlled resistance across the input and output terminals.

* * * * *